US011749941B2

(12) United States Patent
Yamada et al.

(10) Patent No.: US 11,749,941 B2
(45) Date of Patent: Sep. 5, 2023

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Yusuke Yamada, Mie (JP); Junichi Mukuno, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 16 days.

(21) Appl. No.: 17/634,091

(22) PCT Filed: Aug. 18, 2020

(86) PCT No.: PCT/JP2020/031088
§ 371 (c)(1),
(2) Date: Feb. 9, 2022

(87) PCT Pub. No.: WO2021/039494
PCT Pub. Date: Mar. 4, 2021

(65) Prior Publication Data

US 2022/0352672 A1 Nov. 3, 2022

(30) Foreign Application Priority Data

Aug. 30, 2019 (JP) ..... 2019-157785

(51) Int. Cl.
*H01R 13/533* (2006.01)

(52) U.S. Cl.
CPC ..... *H01R 13/533* (2013.01); *H01R 2201/26* (2013.01)

(58) Field of Classification Search
CPC ... H01R 13/533; H01R 13/52; H01R 2201/26
See application file for complete search history.

(56) References Cited

U.S. PATENT DOCUMENTS 7,166,024 B2 * 1/2007 Mashiko ..... H02K 5/10 454/270
2014/0027656 A1 1/2014 Yamada et al.

FOREIGN PATENT DOCUMENTS

CN 207320417 U 5/2018
CN 208548524 U 2/2019
(Continued)

OTHER PUBLICATIONS

International Search Report dated Sep. 29, 2020 for WO 2021/039494 A1 (4 pages).

*Primary Examiner* — Tho D Ta
(74) *Attorney, Agent, or Firm* — Venjuris, P.C.

(57) ABSTRACT

The present disclosure provides a connector capable of improving dissipation performance while suppressing enlargement. A connector 10 includes a connector housing 11 and terminals T to be accommodated into the connector housing 11 and electrically connected to a mating device. The connector housing 11 includes upper slope portions 41*a*, 41*b* inclined with respect to a horizontal direction at positions vertically above the terminals T in a state mounted on the mating device. Breathable upper breathable films 44*a* are provided in upper through holes 43*a*, 43*b* provided in the upper slope portions 41*a*, 41*b*.

5 Claims, 6 Drawing Sheets

(56) References Cited

FOREIGN PATENT DOCUMENTS

| | | | | | |
|---|---|---|---|---|---|
| JP | 2004-266211 | A | | 9/2004 | |
| JP | 2014-164825 | A | | 9/2014 | |
| JP | 2014164825 | A | * | 9/2014 | |
| WO | 2015/060113 | A1 | | 4/2015 | |
| WO | WO-2018131878 | A1 | * | 7/2018 | ..... H01R 13/405 |

* cited by examiner

CONNECTOR

CROSS REFERENCE TO RELATED APPLICATIONS

This application is a national phase of PCT application No. PCT/JP2020/031088, filed on 18 Aug. 2020, which claims priority from Japanese patent application No. 2019-157785, filed on 30 Aug. 2019, all of which are incorporated herein by reference.

TECHNICAL FIELD

The present disclosure relates to a connector.

BACKGROUND

Conventionally, a connector designed to be mounted on a mating device is known (see, for example, Patent Document 1). In such a connector, a part of a wire is inserted into a housing and a core of the wire is electrically connected to an inner conductor and a terminal in the housing. The terminal of the shield connector contacts the mating device or a terminal in a mating connector, whereby the core is electrically connected to the mating device or the terminal in the mating connector.

PRIOR ART DOCUMENT

Patent Document

Patent Document 1: WO 2015/060113 A1

SUMMARY OF THE INVENTION

Problems to be Solved

In the shield connector as described above, heat generated in the terminal and the inner conductor in the housing is mainly transferred to the wire. On the other hand, in a shield connector used in a hybrid vehicle, an electric vehicle or the like, an amount of heat generation increases since a large current is supplied to a device to be connected. Thus, to improve dissipation performance, it is necessary to enlarge a terminal and an inner conductor and enlarge a diameter of a wire, whereby there is a concern that the shield connector itself is also enlarged.

The present disclosure aims to provide a connector capable of improving dissipation performance while suppressing enlargement.

Means to Solve the Problem

The present disclosure is directed to a connector with a connector housing and a terminal to be accommodated into the connector housing and electrically connected to a mating device, wherein the connector housing includes an upper slope portion inclined with respect to a horizontal direction at a position vertically above the terminal in a state mounted on the mating device, and a breathable upper breathable film is provided in an upper through hole provided in the upper slope portion.

Effect of the Invention

According to the connector of the present disclosure, it is possible to improve dissipation performance while suppressing enlargement.

DETAILED DESCRIPTION TO EXECUTE THE INVENTION

Description of Embodiments of Present Disclosure

Figure 1:
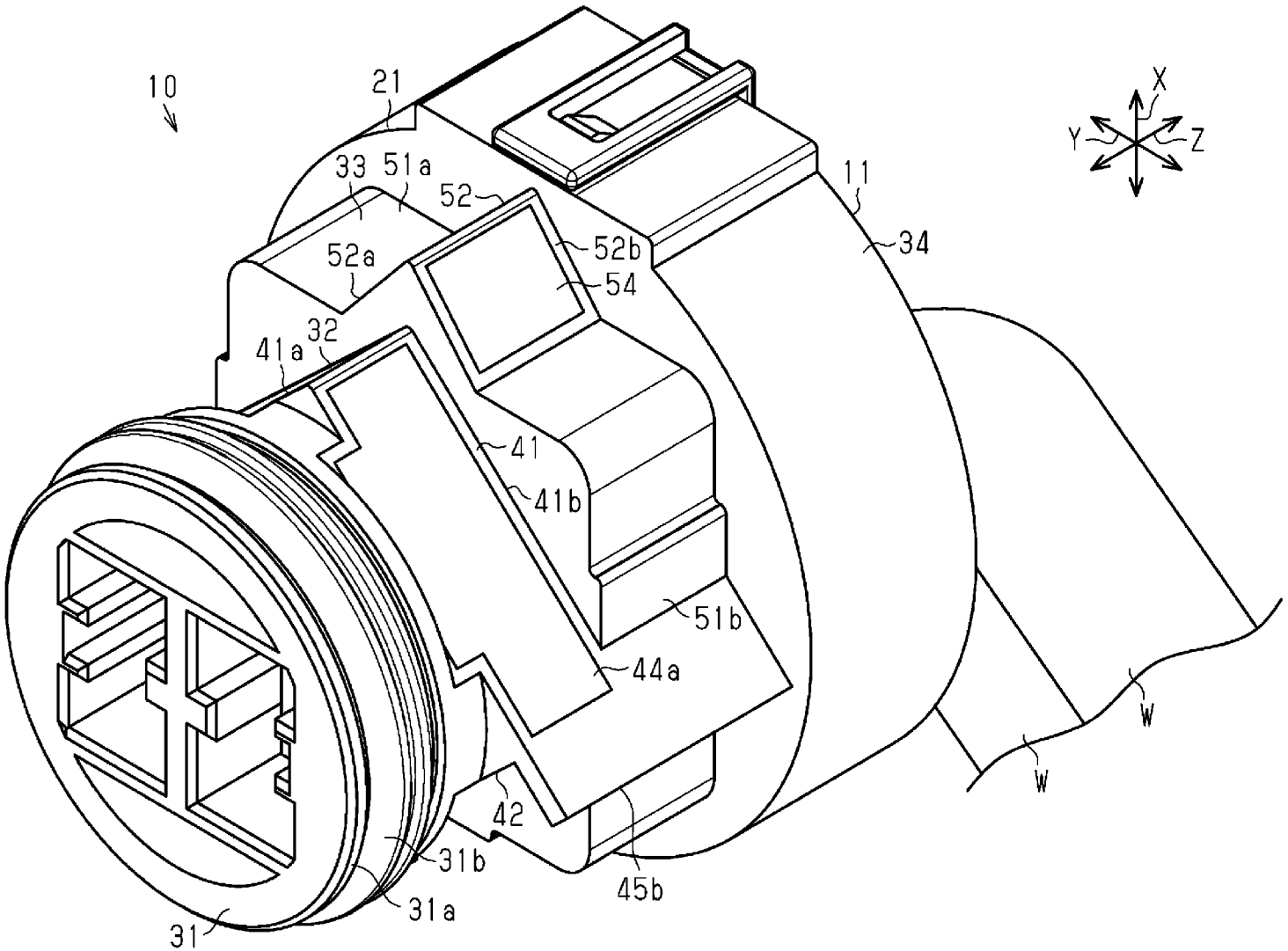
FIG. 1 is a perspective view of a connector in one embodiment.

First, embodiments of the present disclosure are listed and described.

[1] The connector of the present disclosure includes a connector housing and a terminal to be accommodated into the connector housing and electrically connected to a mating device, wherein the connector housing includes an upper slope portion inclined with respect to a horizontal direction at a position vertically above the terminal in a state mounted on the mating device, and a breathable upper breathable film is provided in an upper through hole provided in the upper slope portion.

According to this configuration, dissipation performance can be enhanced while enlargement is suppressed since heat generated in and around the terminal can be dissipated to outside through the upper breathable film provided in the upper slope portion.

[2] Preferably, the connector housing includes a lower through hole at a position vertically below the terminal in the state mounted on the mating device, and a breathable lower breathable film is provided in a lower through hole.

According to this configuration, dissipation performance can be improved by promoting the occurrence of natural convection of air by including the lower breathable film in addition to the upper breathable film.

[3] Preferably, the upper and lower breathable films are arranged to face at least the terminal.

According to this configuration, since the terminal, which easily generates heat, and the respective breathable films are arranged to face each other, heat generated from the terminal can be immediately dissipated.

[4] Preferably, the upper slope portion includes a first upper slope portion inclined downward from a central part to one outer side of the connector housing and a second upper slope portion inclined downward from the central part to the other outer side of the connector housing, and upper end parts of the first and second upper slope portions are connected to form a V shape, and each of the first and second upper slope portions includes an extending wall portion extending from a lower end part.

According to this configuration, foreign matters such as dust and water can be made hard to stay in the lower ends of the respective slope portions and the adhesion of foreign matters to the upper breathable film can be suppressed by including the extending wall portions extending from the lower end parts of the first and second upper slope portions.

[5] Preferably, the extending wall portions are slopes continuous from and having the same angle of inclination as the first and second upper slope portions.

According to this configuration, since the extending wall portions are slopes continuous from and having the same angle of inclination as the first and second upper slope portions, foreign matters such as dust and water can be made hard to stay in the lower ends of the respective slope portions and the adhesion of foreign matters to the upper breathable film can be suppressed.

[6] Preferably, the connector housing includes a lower slope portion inclined with respect to the horizontal direction at a position vertically below the terminal in the state mounted on the mating device, the lower slope portion includes a first lower slope portion inclined downward from one outer side to a central part of the connector housing and a second lower slope portion inclined downward from the other outer side to the central part of the connector housing, and lower end parts of the first and second lower slope portions are connected to form a V shape, and the lower slope portion includes a lower extending portion extending downward from lower end parts of the first and second lower end parts.

According to this configuration, foreign matters such as dust and water can be made hard to stay in the lower ends of the first and second lower slope portions and the adhesion of foreign matters to the lower breathable film can be suppressed by including the lower extending portion extending downward from the lower end parts of the first and second lower slope portions.

Details of Embodiment of Present Disclosure

A specific example of a connector of the present disclosure is described below with reference to the drawings. In each figure, some of components may be shown in an exaggerated or simplified manner for the convenience of description. Further, a dimension ratio of each part may be different in each figure. Note that the present invention is not limited to these illustrations and is intended to be represented by claims and include all changes in the scope of claims and in the meaning and scope of equivalents. "Parallel", "orthogonal" and "horizontal" in this specification mean not only strictly parallel, orthogonal and horizontal, but also substantially parallel, orthogonal and horizontal within a range in which functions and effects in this embodiment are achieved.

Figure 2:
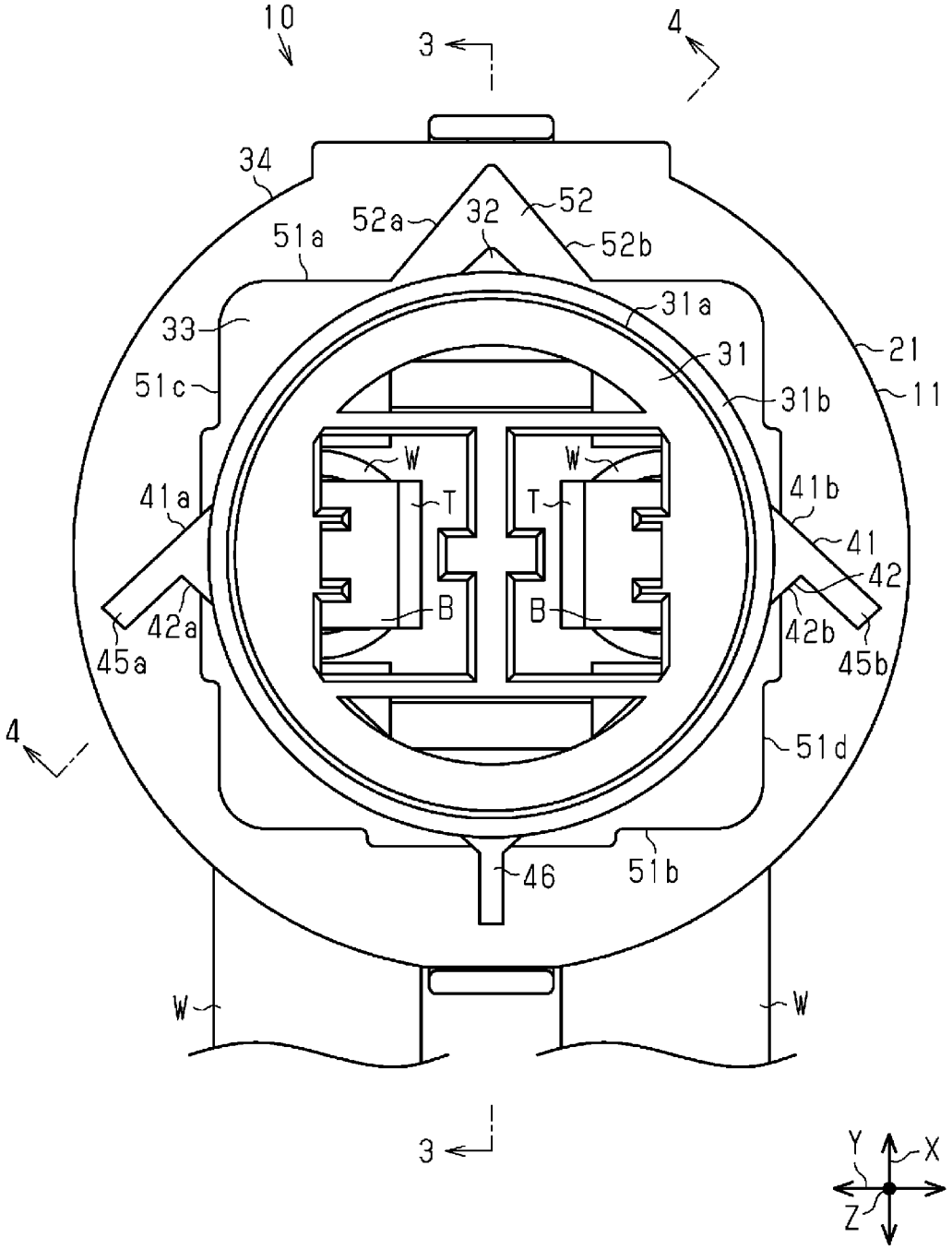
FIG. 2 is a front view of the connector in the embodiment.

A connector 10 shown in FIGS. 1 and 2 is for connecting two wires W extending in parallel to each other to a mating device (not shown). Note that a motor, an inverter and the like installed in a hybrid vehicle, an electric vehicle or the like can be, for example, cited as the mating device. Note that, in the following description, an up-down direction in FIG. 2 is referred to as an up-down direction X, a lateral direction in FIG. 2 is referred to as a lateral direction Y and a direction orthogonal to the plane of FIG. 2 is referred to as a front-rear direction Z.

Figure 3:
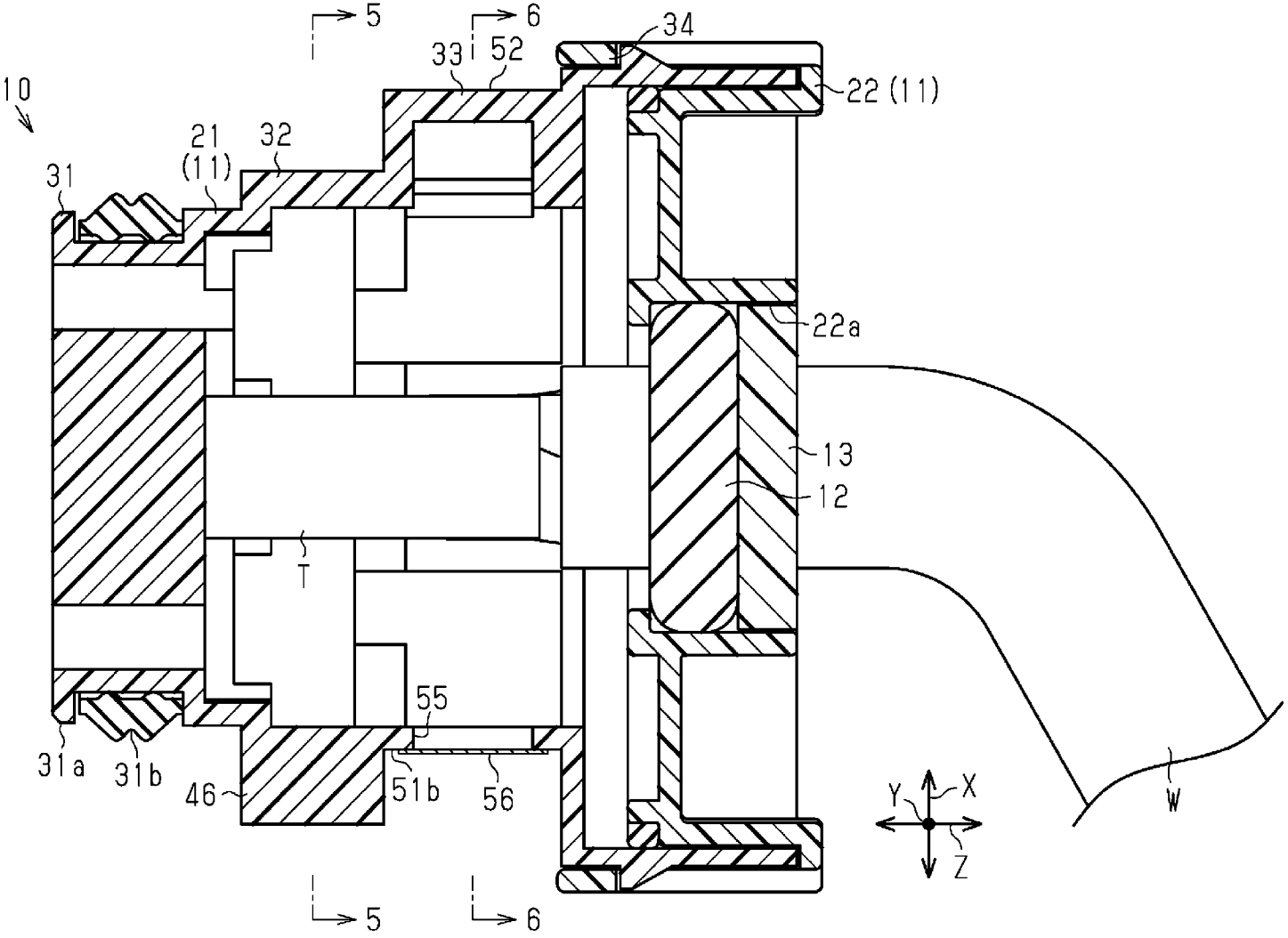
FIG. 3 is a section along 3-3 in FIG. 2.
Figure 4:
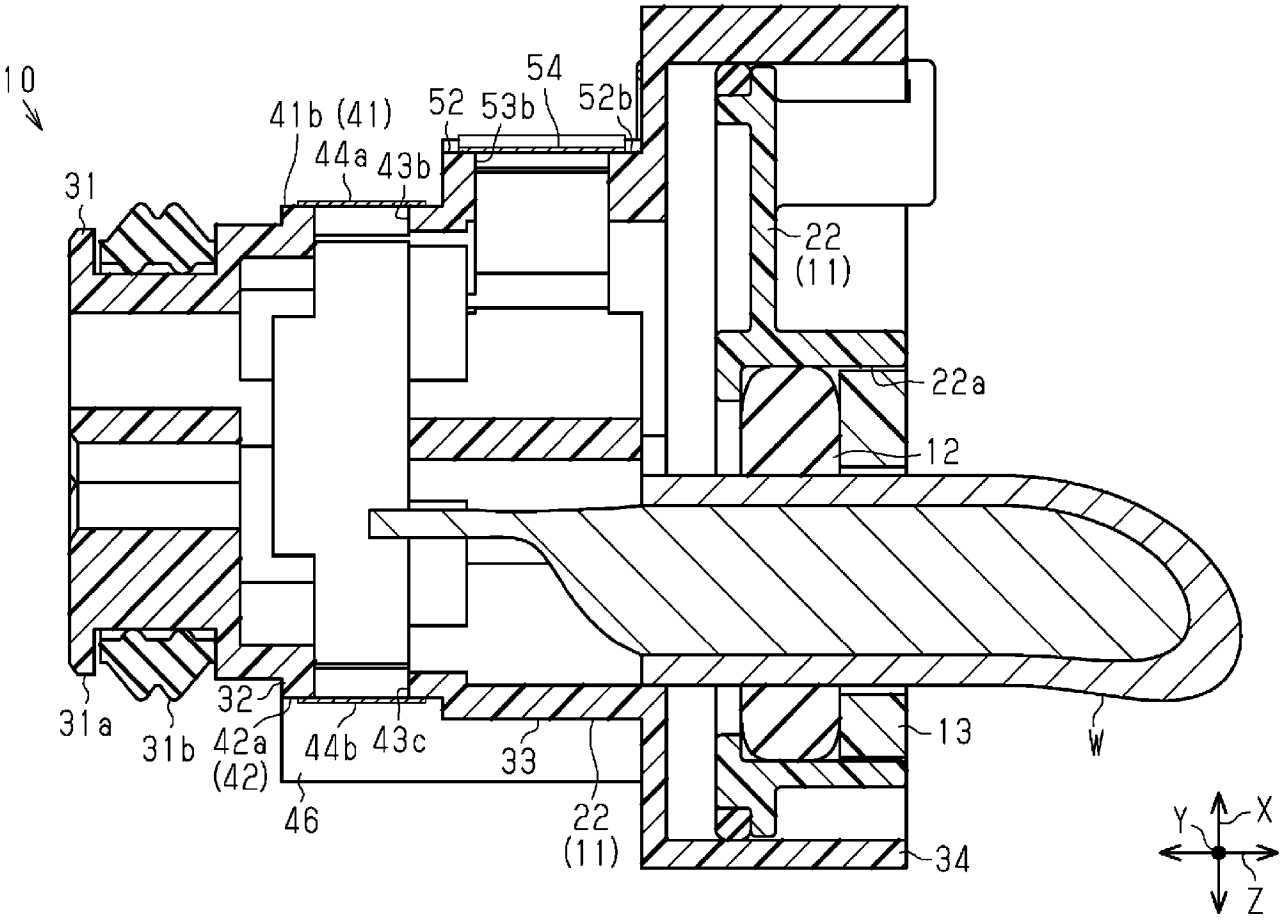
FIG. 4 is a section along 4-4 in FIG. 2.

As shown in FIGS. 3 and 4, the connector 10 includes a connector housing 11 made of synthetic resin and configured to accommodate end parts of the two wires W, sealing members 12 for sealing between each wire W and the connector housing 11, and a retainer 13 for retaining the respective sealing members 12. The retainer 13 is locked to the connector housing 11.

The connector housing 11 includes a front housing 21 and a rear housing 22. The front housing 21 is located on a front side in the front-rear direction Z with respect to the rear housing 22. Note that, in this example, a forward direction in the front-rear direction Z is a mounting direction of the connector 10 on the mating device.

The front housing 21 is configured into a tubular shape. The rear housing 22 is mounted on a rear part of the front housing 21. The rear housing 22 includes inserting portions 22*a* into which the wires W are insertable. The sealing member 12 for sealing between the wire W and the inserting portion 22*a* is provided in the inserting portion 22*a*. Further, the retainer 13 is mounted behind the sealing members 12 in the inserting portions 22*a*.

The end parts, as parts of the two wires W, are accommodated into the connector housing 11. A terminal T is electrically connected to the end part of each wire W via a busbar B, which is an inner conductive member. Note that the terminals T electrically connected to the respective wires W are provided side by side in the lateral direction Y. Here, the lateral direction Y, in which the terminals T are arranged, is a direction parallel to a horizontal direction in a state mounted on the mating device. In other words, the lateral direction Y, in which the terminals T are arranged, is a direction orthogonal to a vertical direction in the state mounted on the mating direction.

The front housing 21 includes a first hollow cylindrical portion 31, a first rectangular tube portion 32, a second rectangular tube portion 33 and a second hollow cylindrical portion 34 in this order from a tip side to be connected to the mating device, i.e. from a front side in the front-rear direction Z.

The first hollow cylindrical portion 31 is configured into a hollow cylindrical shape and connected to the mating device. A sealing member 31*b* in the form of a circular ring is mounted on an outer peripheral part 31*a* of the first hollow cylindrical portion 31 to seal between the mating device and the first hollow cylindrical portion 31 in a state inserted in the mating device.

The second hollow cylindrical portion 34 is configured into a hollow cylindrical shape and has a larger diameter than the first hollow cylindrical portion 31. The second hollow cylindrical portion 34 accommodates the rear housing 22, the sealing members 12 and the retainer 13 inside.

Figure 5:
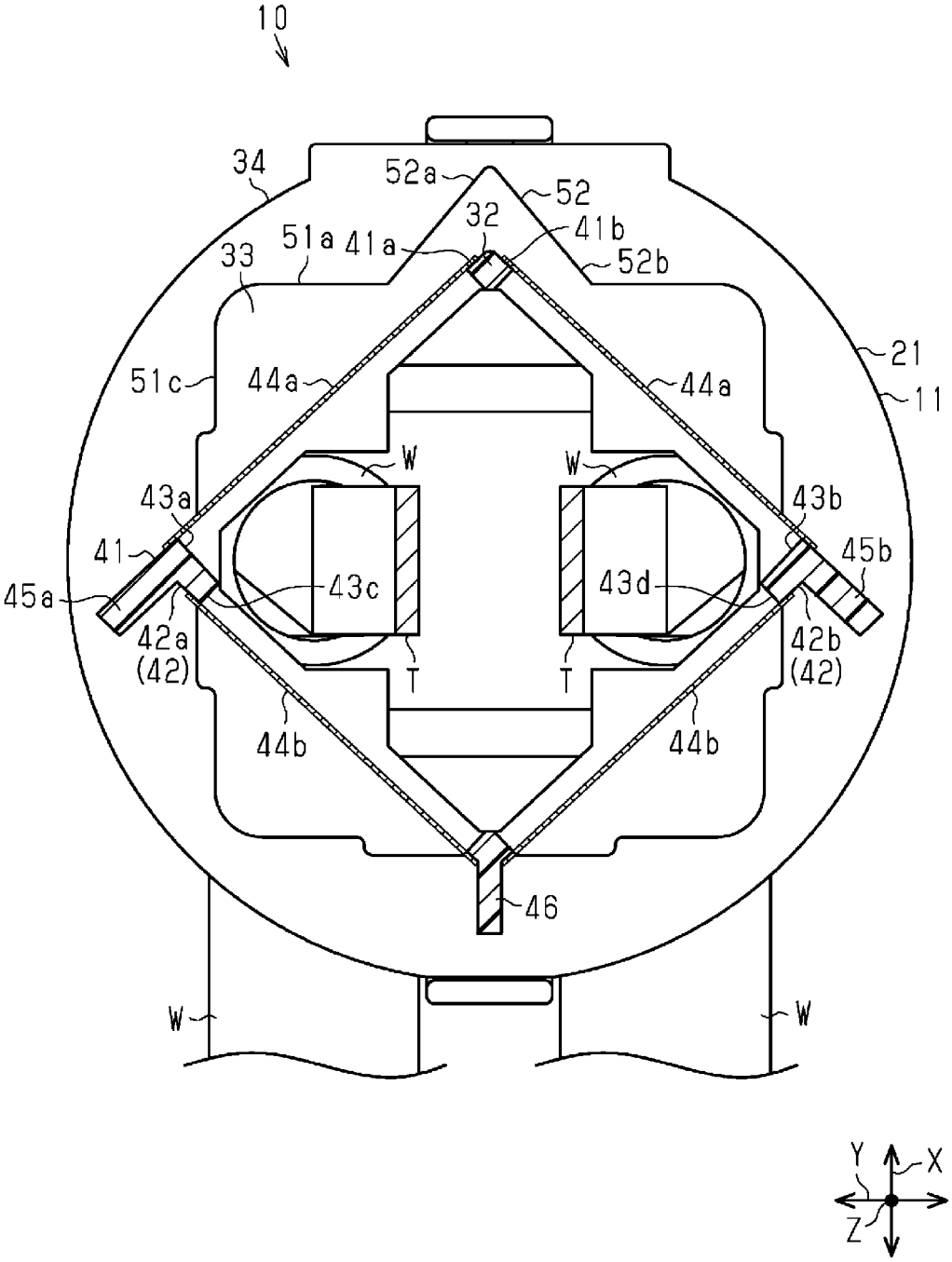
FIG. 5 is a section along 5-5 in FIG. 3.

As shown in FIG. 5, the first rectangular tube portion 32 includes an upper slope portion 41 inclined with respect to the horizontal direction at a position vertically above the terminals T in the state mounted on the mating device and a lower slope portion 42 inclined with respect to the horizontal direction at a position vertically below the terminals T in the state mounted on the mating device.

The upper slope portion 41 includes a first upper slope portion 41*a* inclined downward from a central part to one outer side in the lateral direction Y of the connector housing 11 and a second upper slope portion 41*b* inclined downward from the central part to the other outer side in the lateral direction Y of the connector housing 11. The upper slope portion 41 is configured into a V shape projecting vertically upward by the first and second upper slope portions 41*a*, 41*b*. The first and second upper slope portions 41*a*, 41*b* are, as an example, inclined by 45° with respect to the vertical direction and the horizontal direction with the connector 10 mounted on the mating device. Note that this angle is an example and can be changed as appropriate.

The lower slope portion 42 includes a first lower slope portion 42*a* inclined downward from one outer side in the lateral direction Y to the central part of the connector housing 11 and a second lower slope portion 42*b* inclined downward from the other outer side in the lateral direction Y to the central part of the connector housing 11. The lower slope portion 42 is configured into a V shape projecting vertically downward by the first and second lower slope portions 42*a*, 42*b*. The first and second lower slope portions 42*a*, 42*b* are, as an example, inclined by 45° with respect to the vertical direction and the horizontal direction with the connector 10 mounted on the mating device. Note that this angle is an example and can be changed as appropriate.

As shown in FIG. 5, the first rectangular tube portion 32 includes through holes 43*a*, 43*b*, 43*c* and 43*d* respectively in the first upper slope portion 41*a*, the second upper slope portion 41*b*, the first lower slope portion 42*a* and the second lower slope portion 42*b*. The through hole 43*a* is provided in the first upper slope portion 41*a* and penetrates in a direction orthogonal to the first upper slope portion 41*a*. The through hole 43*b* is provided in the second upper slope portion 41*b* and penetrates in a direction orthogonal to the second upper slope portion 41*b*. The through hole 43*c* is provided in the first lower slope portion 42*a* and penetrates in a direction orthogonal to the first lower slope portion 42*a*. The through hole 43*d* is provided in the second lower slope portion 42*b* and penetrates in a direction orthogonal to the second lower slope portion 42*b*. The respective through holes 43*a*, 43*b*, 43*c* and 43*d* are facing the terminals T in radial directions.

Each of the through holes 43*a*, 43*b* is provided with a breathable film 44*a*. Each of the through holes 43*c*, 43*d* is provided with a breathable film 44*b*. The breathable films 44*a*, 44*b* have a property of allowing the passage of gases such as air and restricting the passage of foreign matters such as liquids and dust. The materials and structures of the breathable films 44*a*, 44*b* are not particularly limited and known ones can be used as appropriate.

Further, the first and second upper slope portions 41*a*, 41*b* of this embodiment respectively include extending wall portions 45*a*, 45*b* extending from lower end parts. The extending wall portion 45*a* is a slope continuous from and having the same angle of inclination as the first upper slope portion 41*a*. Note that the lower end parts of the first and second upper slope portions 41*a*, 41*b* are boundary parts to the first and second lower slope portions 42*a*, 42*b*.

Further, the first and second lower slope portions 42*a*, 42*b* of this embodiment respectively include a lower extending portion 46 extending downward from lower end parts, i.e. a boundary part between the first and second slope portions 42*a*, 42*b*. The lower extending portion 46 extends along the vertical direction with the connector 10 mounted on the mating device.

Figure 6:
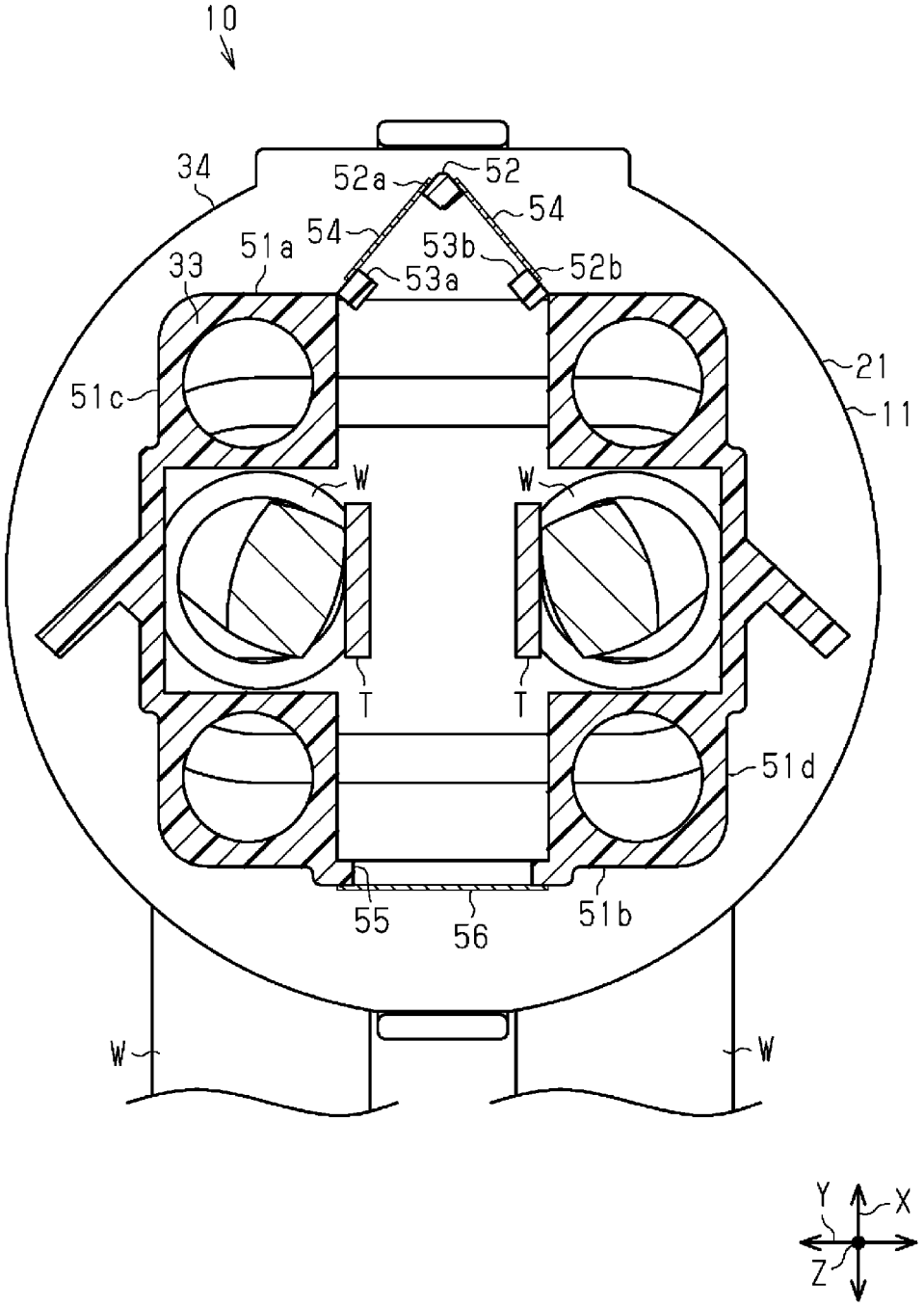
FIG. 6 is a section along 6-6 in FIG. 3.

As shown in FIG. 6, the second rectangular tube portion 33 is configured into a rectangular tube shape. The second rectangular tube portion 33 has four outer side surfaces 51*a*, 51*b*, 51*c* and 51*d* facing outward. The outer side surfaces 51*a*, 51*b* are facing in the up-down direction X, and the outer side surfaces 51*c*, 51*d* are facing in the lateral direction Y. The outer side surfaces 51*a*, 51*b* are surfaces parallel to a direction (horizontal direction) orthogonal to the vertical direction with the connector 10 mounted on the mating device. The outer side surfaces 51*c*, 51*d* are surfaces parallel to a direction (vertical direction) orthogonal to the horizontal direction with the connector 10 mounted on the mating device.

The outer side surface 51*a* facing upward in the up-down direction X is located vertically above the terminals T with the connector 10 mounted on the mating device. The outer side surface 51*a* is provided with a protrusion 52 triangular in a front view.

As shown in FIG. 6, the protrusion 52 has two slope portions 52*a*, 52*b* inclined with respect to the horizontal direction at positions vertically above the terminals T with the connector 10 mounted on the mating device. The slope portion 52*a* is inclined downward from the central part to one outer side in the lateral direction Y of the connector housing 11, and the slope portion 52*a* is inclined downward from the central part to the other outer side in the lateral direction Y of the connector housing 11. The protrusion 52 is configured into a V shape projecting vertically upward by the slope portions 52*a*, 52*b*. Angles of inclination of the slope portions 52*a*, 52*b* with respect to the horizontal direction may be equal to or different from those of the upper slope portions 41*a*, 41*b*.

The slope portions 52*a*, 52*b* respectively have through holes 53*a*, 53*b*. The through hole 53*a* is provided in the slope portion 52*a* and penetrates in a direction orthogonal to the slope portion 52*a*. The through hole 53*b* is provided in the slope portion 52*b* and penetrates in a direction orthogonal to the slope portion 52*b*. Each of the through holes 53*a*, 53*b* is provided with a breathable film 54. The breathable films 54 have a property of allowing the passage of gases such as air and restricting the passage of foreign matters such as liquids and dust. The materials and structures of the breathable films 54 are not particularly limited and known ones can be used as appropriate. The materials and structures of the breathable films 54 may be the same as or different from those of the breathable films 44*a*, 44*b*.

The outer side surface 51*b* facing downward in the up-down direction X is located vertically below the terminals T with the connector 10 mounted on the mating device and is a surface parallel to the horizontal direction. The outer side surface 51*b* includes a through hole 55 penetrating in an orthogonal direction.

As shown in FIGS. 3 and 6, a breathable film 56 is provided in the through hole 55. The breathable film 56 has a property of allowing the passage of gases such as air and restricting the passage of foreign matters such as liquids and dust. The material and structure of the breathable film 56 are not particularly limited and known ones can be used as appropriate. The material and structure of the breathable films 56 may be the same as or different from those of the breathable films 44*a*, 44*b* and 54.

Functions of this embodiment are described.

The connector 10 of this embodiment is electrically connected to the mating device by being mounted on the mating device to bring the terminals T thereof into contact with the terminals of the mating device. If a current is supplied to the wires W and the terminals T in this state, heat is generated in the terminals T and the terminals of the mating device. The generated heat is dissipated through the breathable films 44*a*, 54 located above the terminals T. On the other hand, outside air is taken in through the breathable films 44*b*, 56 located below the terminals T. By providing the breathable films 44*a*, 54, 44*b* and 56 above and below the terminals T in this way, the occurrence of natural convection of air is promoted and heat is efficiently dissipated.

The breathable films 44*a* are provided in the first and second upper slope portions 41*a*, 41*b*, and the breathable films 54 are provided in the slope portions 52*a*, 52*b*. Thus, foreign matters such as water and dust are suppressed from staying in the breathable films 44*a*, 54.

Effects of this embodiment are described.

(1) Dissipation performance can be enhanced while enlargement is suppressed since heat generated in and around the terminals T can be dissipated to outside through the breathable films 44*a* provided in the upper slope portions 41*a*, 41*b*. Further, foreign matters such as water and dust are suppressed from staying in the breathable films 44*a* since the breathable films 44*a* are provided in the first and second upper slope portions 41*a*, 41*b*.

(2) Dissipation performance can be improved by promoting the occurrence of natural convection of air by including the lower breathable films 44*b* in addition to the upper breathable films 44*a*.

(3) Since the terminals T, which easily generated heat, and the respective breathable films 44*a*, 44*b* are arranged to face each other, heat generated from the terminals T can be immediately dissipated.

(4) Foreign matters such as water and dust are suppressed from staying in the lower ends of the respective slope portions 41*a*, 41*b* and the adhesion of foreign matters to the upper breathable films 44*a* can be suppressed by including the extending wall portions 45*a*, 45*b* extending from the lower end parts of the first and second upper slope portions 41*a*, 41*b*.

(5) Since the extending wall portions 45*a*, 45*b* are slopes continuous from and having the same angle of inclination as the first and second upper slope portions 41*a*, 41*b*, foreign matters such as water and dust can be made hard to stay in the lower ends of the respective slope portions 41*a*, 41*b* and the adhesion of foreign matters to the upper breathable films 44*a* can be suppressed.

(6) Foreign matters such as water and dust are suppressed from staying in the lower ends of the first and second lower slope portions 42*a*, 42*b* and the adhesion of foreign matters to the lower breathable films 44*b* can be suppressed by including the lower extending portion 46 extending downward from the lower end parts of the first and second lower slope portions 42*a*, 42*b*.

(7) Dissipation performance can be further enhanced by including the breathable films 54, 56 in addition to the breathable films 44*a*, 44*b*. Further, since the breathable films 54 are provided in the slope portions 52*a*, 52*b* inclined similarly to the breathable films 44*a*, the adhesion of foreign matters to the breathable films 54 can be suppressed.

OTHER EMBODIMENTS

Note that the above embodiment can be modified and carried out as follows. The above embodiment and the following modifications can be carried out in combination without technically contradicting each other.

Although the breathable films 44*a*, 44*b*, 54 and 56 are provided in the above embodiment, there is no limitation to this. A configuration from which the breathable films other than the breathable films 44*a* are omitted may be, for example, adopted. Further, instead of omitting all the breathable films 44*b*, 54 and 56 other than the breathable films 44*a*, only the breathable films 44*b* may be, for example, omitted or the breathable films 54, 56 may be omitted. That is, the breathable films other than the breathable films 44*a* can be changed as appropriate.

Although the lower extending portion 46 is provided in the above embodiment, the lower extending portion 46 may be omitted.

Although the extending wall portions 45*a*, 45*b* are slopes having the same angle of inclination as the upper slope portions 41*a*, 41*b* in the above embodiment, the angles of inclination thereof may be changed as appropriate.

Although the extending wall portions 45*a*, 45*b* are provided in the above embodiment, at least one of the extending wall portions 45*a*, 45*b* may be omitted.

Although the terminals T and the respective breathable films 44*a*, 44*b* are arranged to face each other in the above embodiment, these need not necessarily be arranged to face each other. For example, the breathable films 44*a*, 44*b* may be arranged while being shifted from the terminals T in the front-rear direction. Further, only either the breathable films 44*a* or the breathable films 44*b* may be arranged to face the terminals T and the other breathable films 44*a*, 44*b* may be arranged while being shifted from the terminals T.

Although the lower slope portions 42*a*, 42*b* are provided with the breathable films 44*b* in the above embodiment, there is no limitation to this. For example, the breathable films 44*b* may be provided other than in slopes inclined with respect to the horizontal direction, i.e. provided in surfaces parallel to the horizontal direction.

Although not particularly mentioned in the above embodiment, the terminals T may be male terminals or female terminals.

Although the connector 10 is a non-shield connector including no electromagnetic shield in the above embodiment, the connector 10 may be a shield connector including an electromagnetic shield fixedly provided inside or outside the connector housing 11.

As shown in FIG. 2, when the connector 10 is viewed from the front-rear direction Z, the protrusion 52, the lower extending portion 46 and the extending wall portions 45*a*, 45*b* may be configured to be accommodated radially inwardly of the second hollow cylindrical portion 34. According to this, opening areas of the through holes 43*a*, 43*b*, 43*c* and 43*d*, i.e. ventilation areas can be increased while the enlargement of the connector 10 is suppressed, whereby a size reduction of the connector 10 and an improvement of a dissipation effect can be combined.

LIST OF REFERENCE NUMERALS

B busbar
T terminal
W wire
X up-down direction
Y lateral direction
Z front-rear direction
10 connector
11 connector housing
12 sealing member
13 retainer
21 front housing
22 rear housing
22*a* inserting portion
31 first hollow cylindrical portion
31*a* outer peripheral part
31*b* sealing member
32 first rectangular tube portion
33 second rectangular tube portion
34 second hollow cylindrical portion
41 upper slope portion
41*a* first upper slope portion
41*b* second upper slope portion
42 lower slope portion
42*a* first lower slope portion
42*b* second lower slope portion
43*a*, 43*b*, 43*c*, 43*d* through hole
44*a* breathable film (upper breathable film)
44*b* breathable film (lower breathable film)
45*a*, 45*b* extending wall portion
46 lower extending portion
51*a*, 51*b*, 51*c*, 51*d* outer side surface
52 protrusion
52*a*, 52*b* slope portion

53*a*, 53*b* through hole
54 breathable film
55 through hole
56 breathable film

What is claimed is:

1. A connector, comprising:

a connector housing; and a terminal to be accommodated into the connector housing and electrically connected to a mating device, wherein:

the connector housing includes an upper slope portion inclined with respect to a horizontal direction at a position vertically above the terminal in a state mounted on the mating device, a breathable upper breathable film is provided in an upper through hole provided in the upper slope portion;

the connector housing includes a lower through hole at a position vertically below the terminal in the state mounted on the mating device, and a breathable lower breathable film is provided in a lower through hole.

2. The connector of claim 1, wherein the upper and lower breathable films are arranged to face at least the terminal.

3. The connector of claim 1, wherein:

the connector housing includes a lower slope portion inclined with respect to the horizontal direction at a position vertically below the terminal in the state mounted on the mating device, the lower slope portion includes a first lower slope portion inclined downward from one outer side to a central part of the connector housing and a second lower slope portion inclined downward from the other outer side to the central part of the connector housing, and lower end parts of the first and second lower slope portions are connected to form a V shape, and the lower slope portion includes a lower extending portion extending downward from lower end parts of the first and second lower end parts.

4. The connector of claim 1, wherein:

the upper slope portion includes a first upper slope portion inclined downward from a central part to one outer side of the connector housing and a second upper slope portion inclined downward from the central part to the other outer side of the connector housing, and upper end parts of the first and second upper slope portions are connected to form a V shape, and each of the first and second upper slope portions includes an extending wall portion extending from a lower end part.

5. The connector of claim 4, wherein the extending wall portions are slopes continuous from and having the same angle of inclination as the first and second upper slope portions.

* * * * *